US007553101B2

(12) United States Patent
Harano et al.

(10) Patent No.: US 7,553,101 B2
(45) Date of Patent: Jun. 30, 2009

(54) BAR-LIKE COSMETIC DELIVERING CONTAINER

(75) Inventors: Fumiki Harano, Kyoto (JP); Yoshiyuki Murata, Koto-ku (JP)

(73) Assignee: Otsuka Pharmaceutical Co., Ltd., Tokyo (JP)

( * ) Notice: Subject to any disclaimer, the term of this patent is extended or adjusted under 35 U.S.C. 154(b) by 192 days.

(21) Appl. No.: 10/584,836

(22) PCT Filed: Feb. 17, 2005

(86) PCT No.: PCT/JP2005/002430

§ 371 (c)(1),
(2), (4) Date: Oct. 23, 2006

(87) PCT Pub. No.: WO2005/082202

PCT Pub. Date: Sep. 9, 2005

(65) Prior Publication Data

US 2008/0095567 A1 Apr. 24, 2008

(30) Foreign Application Priority Data

Feb. 27, 2004 (JP) ..... 2004-55534

(51) Int. Cl.
*A65D 40/04* (2006.01)

(52) U.S. Cl. ..... 401/98; 401/75

(58) Field of Classification Search ..... 401/98, 401/49, 68, 75, 202, 213, 243, 269; 206/385

See application file for complete search history.

(56) References Cited

U.S. PATENT DOCUMENTS 3,214,012 A * 10/1965 Mack ..... 206/385

(Continued)

FOREIGN PATENT DOCUMENTS

CN 1128123 A 8/1996

(Continued)

OTHER PUBLICATIONS

Microfilm of the specification and drawings annexed to the request of Japanese Utility Model Application No. 92912/1986 (Laid-Open No. 204512/1987) (Kabushiki Kaisha Hida Seisakusho) Dec. 26, 1987.

(Continued)

*Primary Examiner*—David J Walczak
(74) *Attorney, Agent, or Firm*—Sughrue Mion, PLLC

(57) ABSTRACT

Provided is a bar-like cosmetic delivering container which is internally sealed and suppresses the cosmetic from forming a play due to negative pressure and prevents the lipstick from contacting the inner surface of a lid sleeve body. The bar-like cosmetic delivering container adapted to project and retract the cosmetic by relative rotation between a receiving sleeve body and an outer sleeve body, wherein a lid sleeve body is provided with a sealing sleeve body adapted to fit on the outer sleeve body, thereby sealing the interior of the container. This ensures that even when the lid sleeve body is opened to release the sealing sleeve body, the receiving sleeve body alone is not internally subjected to negative pressure, preventing the lipstick from floating up or forming a play. Further, since the lid sleeve body and the outer sleeve body are fitted together by the sealing sleeve body, relative rotation between the lid sleeve body and the outer sleeve body does not deliver or screw out the lipstick in the container, never causing the lipstick to contact the top surface of the lid sleeve body.

5 Claims, 4 Drawing Sheets

U.S. PATENT DOCUMENTS

| | | | | |
|---|---|---|---|---|
| 5,597,252 | A | 1/1997 | Ito et al. | |
| 5,873,667 | A * | 2/1999 | Inoue et al. | 401/78 |
| 6,070,725 | A | 6/2000 | Ito et al. | |
| 6,340,258 | B2 | 1/2002 | Gueret | |
| 6,623,199 | B2 | 9/2003 | Naramoto et al. | |
| 6,827,213 | B2 | 12/2004 | Hirotomi et al. | |

FOREIGN PATENT DOCUMENTS

| | | | |
|---|---|---|---|
| JP | 1990-122616 | U | 10/1990 |
| JP | 1990-122617 | U | 10/1990 |
| JP | 1990-126510 | U | 10/1990 |
| JP | 1993-89280 | U | 12/1993 |
| JP | 08-019421 | A | 1/1996 |
| JP | 08-024042 | A | 1/1996 |
| JP | 08-089333 | A | 4/1996 |
| JP | 08-089334 | A | 4/1996 |
| JP | 08-117022 | A | 5/1996 |
| JP | 08-117024 | A | 5/1996 |
| JP | 08-173239 | A | 7/1996 |
| JP | 08-214937 | A | 8/1996 |
| JP | 08-228832 | A | 9/1996 |
| JP | 08-238125 | A | 9/1996 |
| JP | 08-242939 | A | 9/1996 |
| JP | 08-242940 | A | 9/1996 |
| JP | 08-256833 | A | 10/1996 |
| JP | 09-056461 | A | 3/1997 |
| JP | 09-056464 | A | 3/1997 |
| JP | 09-075132 | A | 3/1997 |
| JP | 09-182620 | A | 7/1997 |
| JP | 10-179246 | A | 7/1998 |
| JP | 10-211020 | A | 8/1998 |
| JP | 11-196931 | A | 7/1999 |
| JP | 2000-004932 | A | 1/2000 |
| JP | 2000-060637 | A | 2/2000 |
| JP | 3076865 | U | 1/2001 |
| JP | 2001-286336 | A | 10/2001 |
| JP | 2002-186520 | A | 7/2002 |
| JP | 2003-088420 | A | 3/2003 |
| JP | 2003-321073 | A | 11/2003 |
| WO | 9920149 | A | 4/1999 |

OTHER PUBLICATIONS

Microfilm of the specification and drawings annexed to the request of Japanese Utility Model Application No. 32038/1988 (Laid-Open No. 135018/1989) (Kabushiki Kaisha Hida Seisakusho) Sep. 14, 1989.

An English Translation of the First Office Action from CNO dated Apr. 18, 2008.

* cited by examiner

BAR-LIKE COSMETIC DELIVERING CONTAINER

TECHNICAL FIELD

The present invention relates to a container for feeding a stick-type cosmetic material in which a stick-type cosmetic material, such as lipstick, lip cream, stick-type eye shadow, and stick-type foundations, can be contained in an airtight manner.

BACKGROUND OF THE INVENTION

In general, a container for feeding a stick-type cosmetic material, which contains, for example, lipstick, comprises an anti-sliding cylindrical holding member provided inside an outer cylinder in a rotatable manner relative to the outer cylinder. By rotating the outer cylinder and the cylindrical holding member relative to each other, a receiving member provided movably in the cylindrical holding member is moved to thereby extend/retract the stick-type cosmetic material from/into the feeding container.

Also known is a feeding container whose inside is made airtight for the purpose of preventing the stick-type cosmetic material held inside the feeding container from drying out. A prior-art airtight container is shown in FIG. 4. In this airtight container, a cylindrical cover 45 detachably mounted to an outer cylinder 44 has, on its inner surface, an inner cap 43 which fits to an upper open end 42 of a cylindrical holding member 41. Thus, when the cylindrical cover 45 is fitted to the outer cylinder 44, the inner cap 43 seals the inside of the cylindrical holding member 41, which prevents a lipstick 46 from drying, etc.

[Patent Document 1] Japanese Unexamined Patent Publication No. 2001-286336

DISCLOSURE OF THE INVENTION

Problem to be Solved by the Invention

The prior-art airtight container is configured such that the cylindrical holding member 41 is sealed by covering the upper open end 42 thereof with a hermetically covering member, such as the inner cap 43. Such a configuration is problematic in that negative pressure may arise inside the cylindrical holding member 41 because the inner cap 43 is also pulled up relative to the cylindrical holding member 41 when the cylindrical cover 45 is pulled up from the outer cylinder 44. Since a negative pressure is applied to the upper surface of a lipstick 46 held inside the cylindrical holding member 41, the pressure acts in the direction which pulls the lipstick 46 up from the receiving member 47. When the pulling-up force repeatedly acts on the lipstick 46, the lipstick 46 contacts the inner surface of the inner cap 43, (i.e., roof contact) or the lipstick 46 breaks, in some cases.

The cylindrical cover 45 is fitted to the cylindrical holding member 41 by the inner cap 43. Thus, by rotating the cylindrical cover 45 and the outer cylinder 44 relative to each other, the cylindrical holding member 41 is rotated relative to the outer cylinder 44, which results in raising the lipstick 46 in the container. This sometimes posed problems such that the upper surface of the lipstick 46 contacts the inner roof surface of the cylindrical cover 45, i.e., the inner surface of the inner cap 43.

The invention aims to provide a container for feeding a stick-type cosmetic material, in which a cosmetic material, such as lipstick or the like, is contained in an airtight manner, and further aims, in the container for feeding a stick-type cosmetic material, to prevent the cosmetic material from breaking; and to prevent the lipstick from contacting the inner roof surface of the cylindrical cover.

Means for Solving the Problem

In order to solve the above-described problems, the invention provides a container for feeding a stick-type cosmetic material configured as described below.

Item 1. A container for feeding a stick-type cosmetic material comprising:

an outer cylinder;

a cylindrical cover detachably fitting to the outer cylinder;

a cylindrical holding member provided inside the outer cylinder in a rotatable manner relative to the outer cylinder;

a cosmetic material held movably in an axial direction in the cylindrical holding member, the cosmetic material being extended from and retracted into the cylindrical holding member by rotating the cylindrical holding member and the outer cylinder relative to each other; and a hermetically-covering cylindrical member provided on an inner surface of the cylindrical cover, the hermetically-covering cylindrical member fitting hermetically to the outer cylinder.

Item 2. The container for feeding a stick-type cosmetic material according to Item 1, further comprising:

a cylindrical fitting member which has, on its upper outer surface, an annular rib pressing an outer surface of a lower end of the hermetically-covering cylindrical member; and a gap formed between the outer surface of the lower end portion of the hermetically-covering cylindrical member and an inner surface of the cylindrical cover, the gap serving as a space allowing deformation of the lower end portion of the hermetically-covering cylindrical member.

Item 3. The container for feeding a stick-type cosmetic material according to Item 1 or 2, further comprising a receiving member provided in such a manner as to move in the axial direction in the cylindrical holding member integrally with the stick-type cosmetic material by rotation of the outer cylinder and the cylindrical holding member relative to each other, and the annular rib provided at substantially the same height as an upper portion of the receiving member positioned at the lowest end of the cylindrical holding member.

Item 4. The container for feeding a stick-type cosmetic material according to any one of Items 1 to 3, further comprising a cylindrical sealing member provided inside the cylindrical fitting member in such a manner as to slidably and hermetically contact the outer surface of the cylindrical holding member.

Effect of the Invention

The invention is configured as described above, and thus exhibits the following effects.

When the cylindrical cover is removed, the hermetically-covering cylindrical member is also detached from the cylindrical fitting member. Thus, a high level of negative pressure does not arise inside the cylindrical holding member, which prevents the cosmetic material from breaking due to negative pressure. Moreover, when the outer cylinder and the cylindrical cover are rotated relative to each other, no rotation occurs between the cylindrical holding member and the outer cylinder. Thus, the cosmetic material does not move in the container, which prevents the cosmetic material, such as lipstick, from contacting the inner surface of the roof of the cylindrical cover.

The lower end portion of the hermetically-covering cylindrical member is pressed towards the outside by the annular rib of the cylindrical fitting member to bring it into contact with the cylindrical fitting member and the cylindrical cover. Therefore, the airtightness inside the feeding container can be securely maintained.

The fitting position of the hermetically-covering cylindrical member is located at substantially the same height as an upper portion of the receiving member. This reduces negative pressure generated in the cylindrical holding member when the cylindrical cover is pulled up, and therefore the possibility of breaking the cosmetic material can be reduced.

The cylindrical sealing member can improve the airtightness of the container and thus the drying of the cosmetic material can be avoided.

DESCRIPTION OF REFERENCE NUMERALS

Figure 1:
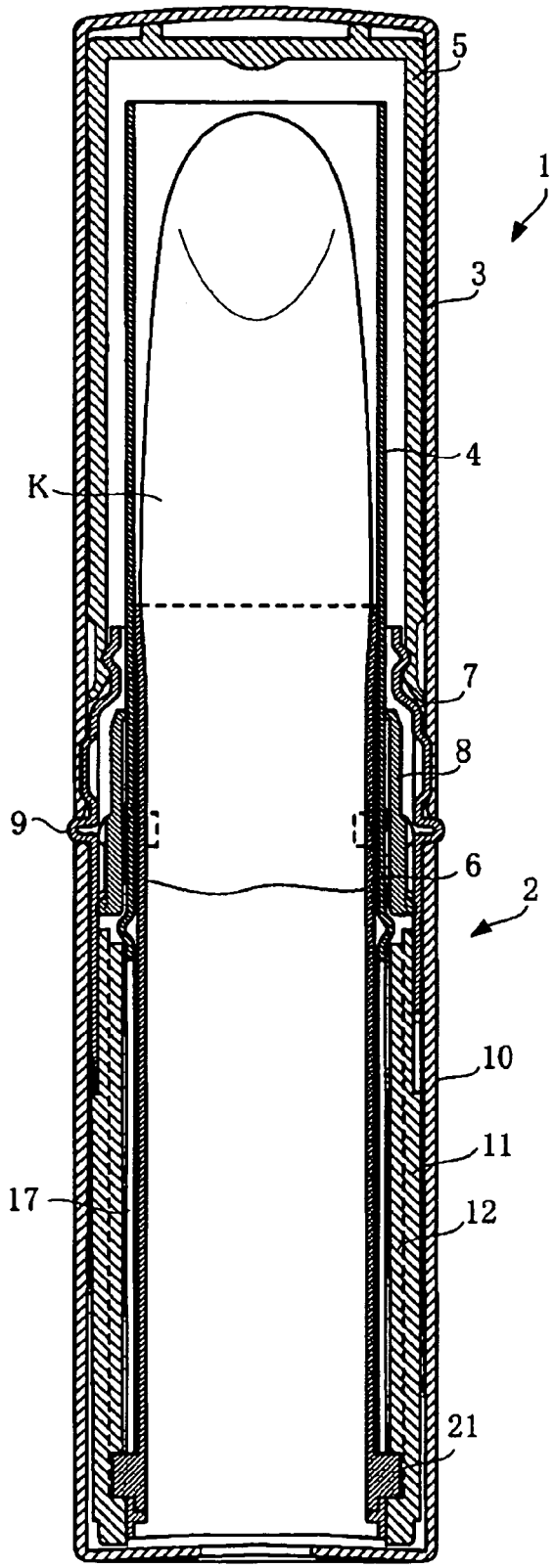
FIG. 1 is a general longitudinal cross section of the container for feeding a stick-type cosmetic material of the invention.

1. container
2. outer cylinder
3. cylindrical cover
4. cylindrical holding member
5. hermetically-covering cylindrical member
6. receiving member
7. cylindrical fitting member
8. cylindrical sealing member
9. ring
10. outer cylindrical case
11. spirally-grooved member
12. spiral groove
13. gap
14. annular rib
17. vertical guide slot
21. engagement projection
K. lipstick

BEST MODE FOR CARRYING OUT THE INVENTION

An embodiment of the container for feeding a cosmetic material of the invention is described with reference to the drawings.

As shown in FIG. 1, a container for feeding a stick-type cosmetic material 1 (hereafter referred to as "container 1") comprises an outer cylinder 2, a cylindrical cover 3 detachably fitting to the outer cylinder 2, a cylindrical holding member 4 rotatably provided inside the outer cylinder 2, a receiving member 6 ascendably and descendably disposed inside the cylindrical holding member 4, a lipstick K as a cosmetic material fixed to the receiving member 6, and the like.

Figure 2:
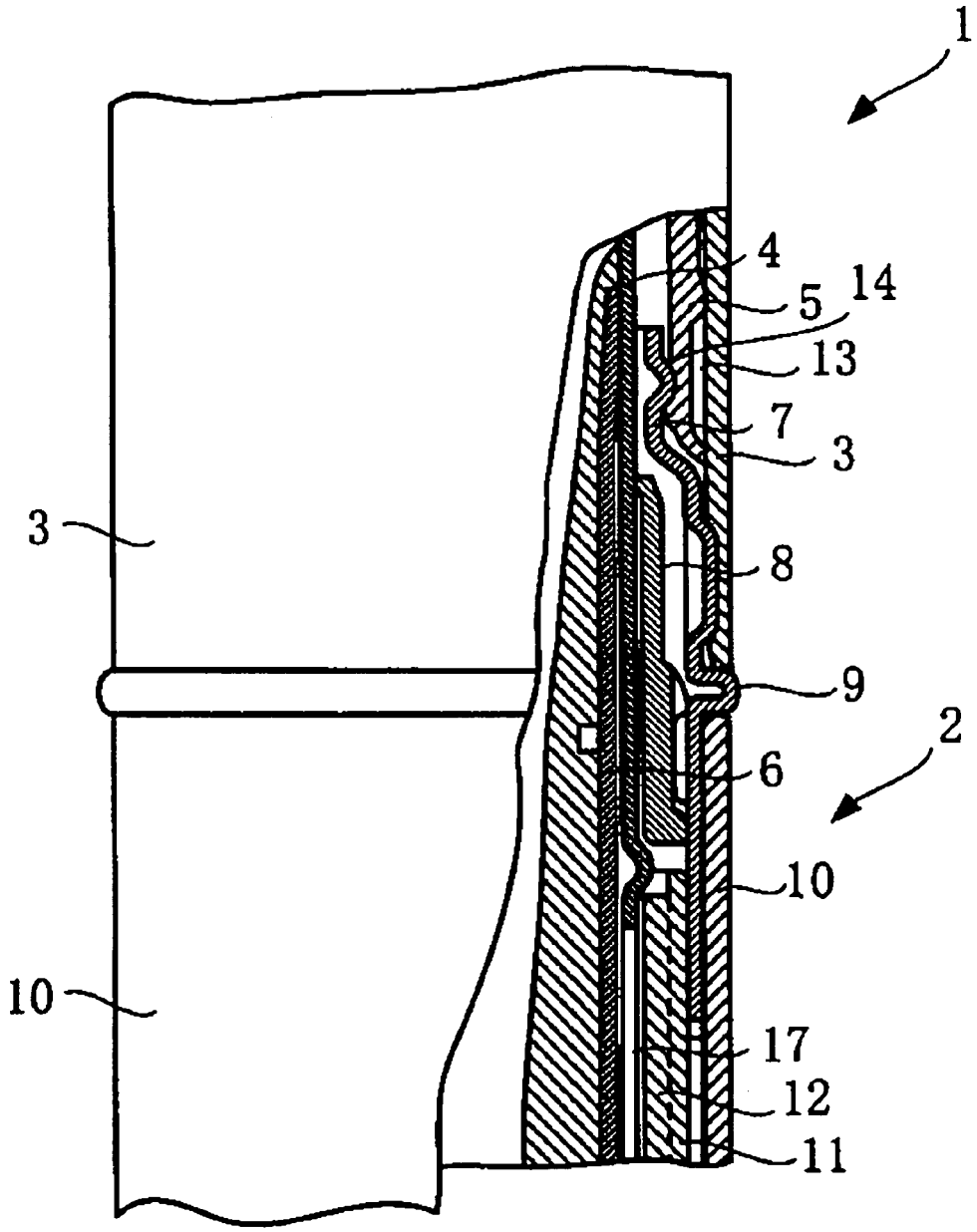
FIG. 2 is a partially enlarged cross section of the container for feeding a stick-type cosmetic material of FIG. 1.
Figure 3:
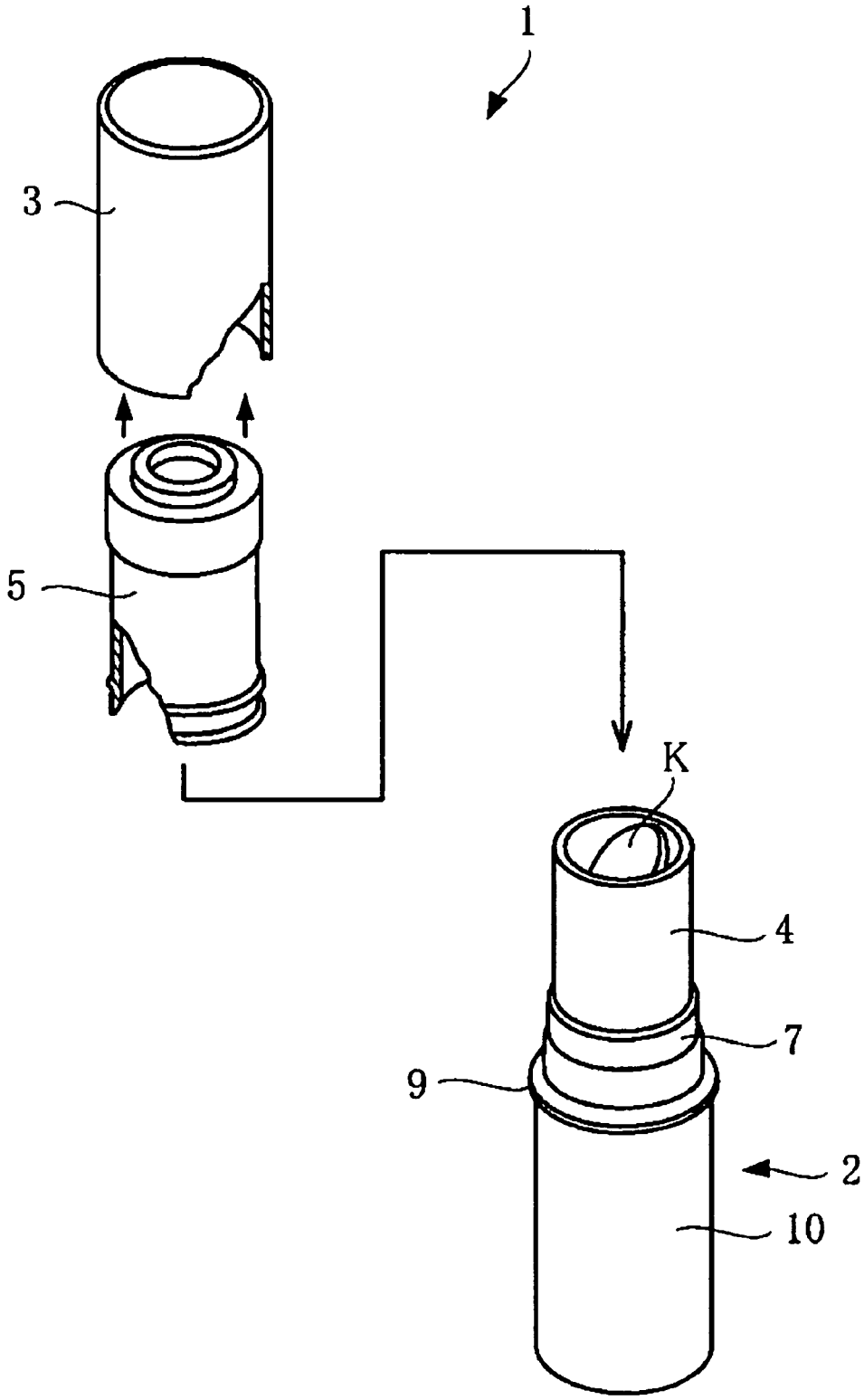
FIG. 3 is a perspective exploded view of the container for feeding a stick-type cosmetic material of the invention.
Figure 4:
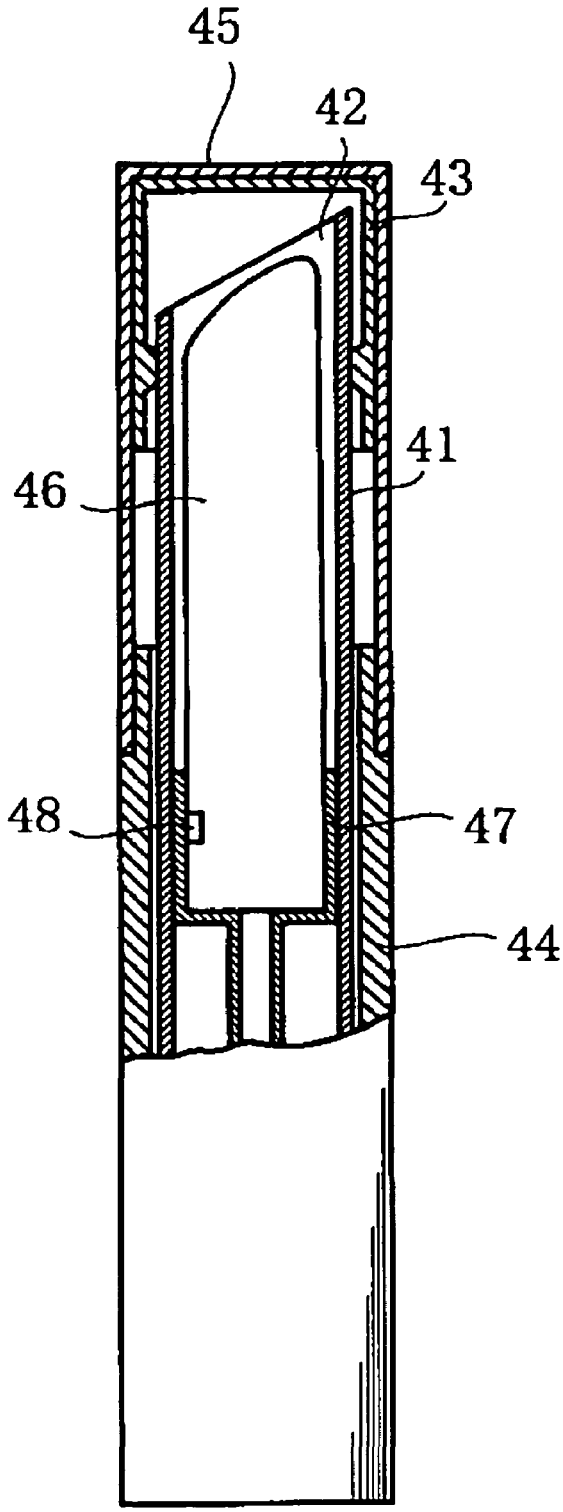
Fig. 4 PRIOR ART
FIG. 4 is a perspective view showing a prior art.

As shown in FIG. 3, the cylindrical cover 3 is shaped like a cylinder with a lid and is integrally provided on its inner surface with a hermetically-covering cylindrical member 5 having a lid. The hermetically-covering cylindrical member 5 is made of an elastic material such as rubber, synthetic resin, or the like. As shown in FIG. 2, the outer surface of the lower portion of the hermetically-covering cylindrical member 5 has a concave shape, and a gap 13 is formed between the outer surface of the lower portion of the hermetically-covering cylindrical member 5 and the inner surface of the cylindrical cover 3.

The outer cylinder 2 comprises an outer cylindrical case 10, a spirally-grooved member 11 fixed non-rotatably inside the outer cylindrical case 10, a cylindrical fitting member 7, and the like. The cylindrical holding member 4 is rotatably and non-slidably provided inside the spirally-grooved member 11. The bottom of the outer cylindrical case 10 is sealed by, for example, attaching a sealing member (not shown), or the like.

The cylindrical fitting member 7 has a cylindrical shape and is non-rotatably and integrally provided on the upper end of the outer cylindrical case 10. The cylindrical fitting member 7 has a ring 9 projecting outwardly in its substantially center portion. The portion under the ring 9 of the cylindrical fitting member 7 is integrally fitted to the inner surface of the outer cylindrical case 10, while the portion above the ring 9 of the cylindrical fitting member 7 curves outwardly in such a manner as to fit to the inner surface of the lower end of the cylindrical cover 3. An annular rib 14 projecting outwardly is formed directly under the upper end of the cylindrical fitting member 7.

Inside the cylindrical fitting member 7, a cylindrical sealing member 8 is attached hermitically and non-rotatably. The sealing member 8 has a cylindrical shape and is made of an elastic material. The inner surface of the upper portion of the sealing member 8 hermetically and slidably contacts the outer surface of the cylindrical holding member 4.

The spirally-grooved member 11 has two spiral grooves. The number of spiral grooves 12 is not limited to two.

The cylindrical holding member 4 is provided inside the spirally-grooved member 11 in a rotatable manner thereto. At the side of the cylindrical holding member 4, two vertical guide slots 17 facing each other across the central axis are formed reaching substantially the central part of the cylindrical holding member 4 in parallel with the center of the axis.

Inside the cylindrical holding member 4, the receiving member 6 fixing the lipstick K is slidably provided. The engagement projections 21 are formed at two places in such a manner as to project outwardly from the receiving member 6, and penetrate the vertical guide slots 17 to be engaged into the spiral grooves 12. The number of engagement projections is not limited to two, and may be determined according to the number of the spiral grooves 12.

Hereinafter, action of the container for feeding a stick-type cosmetic material 1 is described.

When the cylindrical cover 3 is mounted to the outer cylinder 2, the inner surface of the lower end of the cylindrical cover 3 fits to the outer surface of the cylindrical fitting member 7 and simultaneously the hermetically-covering cylindrical member 5 fits to the upper outer surface of the cylindrical fitting member 7. Due to the gap 13 formed between the hermetically-covering cylindrical member 5 and the cylindrical cover 3, the annular rib 14 formed in the cylindrical fitting member 7 presses and deforms the hermetically-covering cylindrical member 5 from the inward direction to the outward direction, thereby bringing the cylindrical fitting member 7 into contact with the hermetically-covering cylindrical member 5.

Since the cylindrical sealing member 8 maintains airtightness between the cylindrical fitting member 7 and the cylindrical holding member 4, the inside of the container 1 (i.e., the lipstick K holding part) is held airtight. This prevents the lipstick K held in the cylindrical holding member 4 from drying, etc.

The cylindrical cover 3 fits to the outer cylinder 2 via the hermetically-covering cylindrical member 5 and does not fit to the cylindrical holding member 4. Therefore, if the outer cylinder 2 and the cylindrical cover 3 are rotated relative to each other in the above-described state, the cylindrical holding member 4 does not rotate. This prevents the lipstick K from moving in the cylindrical holding member 4 when the cylindrical cover 3 is accidentally rotated during storage. Therefore, the upper end of the lipstick K does not contact the inner surface of the roof of the cylindrical cover 3 (i.e., the hermetically-covering cylindrical member 5), and thus, no so-called "roof contact of the lipstick" occurs.

When the cylindrical cover 3 is removed from the outer cylinder 2 while using the lipstick K, the hermetically-covering cylindrical member 5 is pulled up while remaining fitted to the cylindrical fitting member 7, which reduces the atmospheric pressure inside the container. However, since a change in atmospheric pressure occurs not only inside the cylindrical holding member 4 but also inside the whole container 1, the lipstick K is not pulled up by negative pressure, and moreover there is no breaking or "roof contact" of the lipstick K caused by opening or closing the cylindrical cover 3.

When the outer cylindrical case 10 and the cylindrical holding member 4 are rotated relative to each other after removing the cylindrical cover 3, the receiving member 6 goes up in the cylindrical holding member 4 along the vertical guide slots 17, and thus the lipstick K is extended from the open end of the cylindrical holding member 4.

On the contrary, when the lipstick K is retracted in the cylindrical holding member 4 by performing the reverse operation, the cylindrical cover 3 is fitted to the outer cylinder 2 to thereby seal the container 1. In the invention, examples of the cosmetic materials are not limited to lipstick.

The invention claimed is:

1. A container for feeding a stick-type cosmetic material comprising:

an outer cylinder;

a cylindrical cover detachably fitting to the outer cylinder;

a cylindrical holding member provided inside the outer cylinder in a rotatable manner relative to the outer cylinder;

a stick-type cosmetic material held movably in an axial direction in the cylindrical holding member, the cosmetic material being extended from and retracted into the cylindrical holding member through an open end thereof by rotating the outer cylinder and the cylindrical holding member relative to each other;

a hermetically-covering cylindrical member provided on an inner surface of the cylindrical cover, the hermetically-covering cylindrical member fitting hermetically to a cylindrical fitting member disposed at an upper portion of the outer cylinder to maintain airtightness;

an annular rib provided on an upper outer surface of the cylindrical fitting member, the annular rib pressing an outer surface of a lower end of the hermetically-covering cylindrical member; and a gap formed between the outer surface of the lower end of the hermetically-covering cylindrical member and an inner surface of the cylindrical cover, the gap serving as a space allowing deformation of the lower end of the hermetically-covering cylindrical member;

wherein the cylindrical fitting member is not in contact with the cylindrical holding member.

2. The container for feeding a stick-type cosmetic material according to claim 1, further comprising:

a receiving member provided in such a manner as to move in the axial direction in the cylindrical holding member integrally with the stick-type cosmetic material by rotation of the outer cylinder and the cylindrical holding member relative to each other; and the annular rib provided at substantially the same height as an upper portion of the receiving member positioned at the lowest end of the cylindrical holding member.

3. The container for feeding a stick-type cosmetic material according to claim 2, further comprising a cylindrical sealing member provided inside the cylindrical fitting member in such a manner as to slidably and hermetically contact an outer surface of the cylindrical holding member.

4. The container for feeding a stick-type cosmetic material according to claim 1, further comprising a cylindrical sealing member provided inside the cylindrical fitting member in such a manner as to slidably and hermetically contact an outer surface of the cylindrical holding member.

5. The container for feeding a stick-type cosmetic material according to claim 4, wherein the cylindrical sealing member is a separate member.

* * * * *